US010760861B2

(12) United States Patent
Williams

(10) Patent No.: US 10,760,861 B2
(45) Date of Patent: Sep. 1, 2020

(54) FIREARM SLIDE WITH SLOPED BOTTOM SURFACE

(71) Applicant: Springfield, Inc., Geneseo, IL (US)

(72) Inventor: Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 16/252,803

(22) Filed: Jan. 21, 2019

(65) Prior Publication Data

US 2019/0226777 A1 Jul. 25, 2019

Related U.S. Application Data

(60) Provisional application No. 62/620,056, filed on Jan. 22, 2018.

(51) Int. Cl.

| | |
|---|---|
| ***F41A 3/66*** | (2006.01) |
| ***F41C 3/00*** | (2006.01) |
| ***F41A 9/54*** | (2006.01) |
| *F41A 9/45* | (2006.01) |

(52) U.S. Cl.

CPC ..... *F41A 3/66* (2013.01); *F41A 9/54* (2013.01); *F41C 3/00* (2013.01); *F41A 9/45* (2013.01)

(58) Field of Classification Search

CPC ..... F41A 3/00; F41A 3/12; F41A 3/26; F41A 9/38; F41A 9/39; F41A 9/40; F41A 9/41; F41C 31/00; F41C 3/00

USPC ..... 42/14, 15, 16, 17, 18, 28, 29, 34, 35, 42/69.02

See application file for complete search history.

(56) References Cited

U.S. PATENT DOCUMENTS

| | | | | | |
|---|---|---|---|---|---|
| 3,345,770 | A * | 10/1967 | Scanlon, Jr. | F41A 3/74 | 42/18 |
| 4,358,986 | A * | 11/1982 | Giorgio | F41A 3/26 | 89/1.4 |
| 4,563,937 | A * | 1/1986 | White | F41A 3/26 | 42/7 |
| 5,615,505 | A * | 4/1997 | Vaid | F41A 9/61 | 42/18 |
| 5,678,342 | A * | 10/1997 | Felk | F41A 15/16 | 42/69.02 |
| 5,906,066 | A * | 5/1999 | Felk | F41A 3/04 | 42/69.02 |
| 7,140,141 | B2 * | 11/2006 | Vaid | F41A 11/00 | 42/108 |

(Continued)

OTHER PUBLICATIONS

Digital Photo of Glock Slide (Bottom View) Thefirearmblog.com. Posted Aug. 25, 2017.

(Continued)

*Primary Examiner* — Derrick R Morgan

(74) *Attorney, Agent, or Firm* — Woodard, Emhardt, Henry, Reeves & Wagner, LLP

(57) ABSTRACT

Improvements to firearms that load cartridges from a magazine and/or a clip are disclosed. Specifically, improvements to slide assemblies and bolt assemblies to depress a cartridge in a magazine and/or a clip are provided. Such improvements include a sloped bottom-facing surface of the slide assembly and/or bolt assembly. The sloped bottom-facing surface is sloped along the length of the portion that contacts a cartridge in the magazine and/or clip when the slide assembly and/or bolt assembly reciprocates.

20 Claims, 5 Drawing Sheets

(56) References Cited

U.S. PATENT DOCUMENTS

| | | | | |
|---|---|---|---|---|
| 7,690,144 | B2 * | 4/2010 | Fagundes de Campos | F41A 17/72 42/69.02 |
| 8,176,836 | B2 * | 5/2012 | Peev | F41A 19/35 42/69.02 |
| 8,333,142 | B1 * | 12/2012 | Karfiol | F41A 9/25 89/196 |
| 8,572,878 | B2 * | 11/2013 | Gentilini | F41A 17/72 42/69.01 |
| 8,839,541 | B1 * | 9/2014 | Karfiol | F41A 9/55 42/6 |
| 8,925,232 | B2 * | 1/2015 | da Silveira | F41A 19/12 42/69.02 |
| 9,915,485 | B2 * | 3/2018 | Hudson, III | F41A 3/86 |
| 9,927,200 | B2 * | 3/2018 | Kuracina | F41A 19/30 |
| 2011/0289811 | A1 * | 12/2011 | Gentilini | F41A 17/72 42/69.02 |
| 2012/0317856 | A1 * | 12/2012 | Burke | F41A 11/02 42/16 |
| 2014/0317982 | A1 * | 10/2014 | Gentilini | F41A 3/12 42/16 |
| 2015/0276334 | A1 * | 10/2015 | Pflaumer | F41A 3/62 89/191.01 |
| 2016/0047613 | A1 * | 2/2016 | Hudson, III | F41A 3/86 42/14 |
| 2016/0231075 | A1 * | 8/2016 | Wolf | F41A 19/29 |
| 2016/0320154 | A1 * | 11/2016 | Krieger | F41A 17/64 |
| 2017/0227310 | A1 * | 8/2017 | Gorza | F41A 9/53 |
| 2017/0321980 | A1 * | 11/2017 | Wolf | F41A 19/15 |
| 2017/0328656 | A1 * | 11/2017 | O'Clair | F41A 9/65 |
| 2017/0370664 | A1 * | 12/2017 | Popikov | F41A 3/12 |
| 2018/0087857 | A1 * | 3/2018 | Davis | F41A 5/02 |
| 2018/0112945 | A1 * | 4/2018 | Sroufe | F41A 11/00 |
| 2019/0107363 | A1 * | 4/2019 | Harrigan | F41A 3/66 |

OTHER PUBLICATIONS

Digital Photo of Sig Sauer P238 Slide https://www.youtube.com/watch?v=PXmENueTu6g, Posted Aug. 28, 2012.
Digital Photo of Glock Slide (Bottom View).
Digital Photo of Sig Sauer P238 Slide.

* cited by examiner

FIREARM SLIDE WITH SLOPED BOTTOM SURFACE

BACKGROUND

The present invention pertains generally to firearms. In particular, the present disclosure pertains to firearms that load cartridges from a magazine or a clip.

In many firearms that load cartridges from a magazine or a clip, a slide assembly or a bolt assembly serves as a breechblock that holds a cartridge in the chamber. When the assembly is in a forward position (i.e., holding a cartridge in the chamber), the next cartridge in the magazine or clip is positioned lateral to the assembly (e.g., to the bottom or side of the slide assembly or the bolt assembly). When the assembly retracts, a casing of an expended cartridge in the chamber is extracted and ejected. Then when the assembly moves forward again a new cartridge is stripped from the magazine or the clip and loaded into the chamber.

During normal operation of the firearm, cartridges are sequentially loaded into the chamber, fired, extracted, and ejected before a subsequent cartridge begins the same process. However, in some instances, a malfunction occurs in this process.

As individuals (e.g., military and law enforcement professionals) rely on firearms in life and death situations, there is a desire in the field to make firearms highly reliable. Accordingly, there is a desire to reduce and/or eliminate the root causes for these and other types of malfunctions. There is also a desire to increase the accuracy and precision of firearms. Thus, there is a desire for continued development in this field.

SUMMARY

There are a variety of malfunctions that can occur during operation of a firearm. One type of malfunction (hereinafter referred to as a "Type 1 malfunction") is a failure to feed or fire. In a failure to feed, the slide assembly or bolt assembly fails to properly load a cartridge into the chamber. For example, the slide assembly or the bolt assembly may strip a cartridge from the magazine or the clip but fails to fully insert the cartridge into the chamber. In this instance, the slide assembly or the bolt assembly may not fully seat in a forward position, often referred to as an "out of battery" situation.

Another type of malfunction (hereinafter referred to as a "Type 2 malfunction") is a failure to eject. In this scenario, a casing is extracted from the chamber but is not fully ejected before the slide assembly or bolt assembly returns to a forward position. In many cases, the casing is captured between the slide assembly or bolt assembly and the chamber, commonly referred to as a "stovepipe" situation.

A third type of malfunction (hereinafter referred to as a "Type 3 malfunction") is a failure to extract. In this scenario, a cartridge is not properly removed from the chamber. In a "worst-case" scenario, the slide assembly or bolt assembly advances another cartridge behind the one in the chamber creating what is referred to as a "double-feed."

In many firearms, malfunctions occur due to interference between components during operation. Specifically, Type 1 and Type 2 malfunctions can occur due to contact between a cartridge in the magazine or the clip and the casing being extracted from the chamber. More specifically, the cartridge in the magazine or the clip may contact the base of the casing being extracted, causing the casing to become displaced relative to the extractor and/or ejector.

To remedy this issue, the bottom surface of the slide may be provided with a bump that depresses the cartridge in the magazine to keep it out of the way of the casing being extracted and ejected. For example, the Sig Sauer P238 has a small bump on the bottom of the slide just rearward of the breech face. This bump is arranged to strike and depress a cartridge in the magazine after the slide has traveled rearwardly for a short distance. Similarly, pistols sold by Glock have a ramp that comes into contact with a cartridge in the magazine after the slide has traveled rearwardly for a short distance and depresses the cartridge away from the extracted casing.

While the small bump of the Sig Sauer P238 and the ramp of the Glock pistols depress the cartridge in the magazine, Applicant has found the contact of the cartridge with the bump and the ramp of these firearms to produce an abrupt change in speed of the slide. Applicant believes this abrupt change in speed produces a jerky feeling in the recoil of the firearm. This jerky recoil can be uncomfortable to some shooters, particularly those who desire a smooth recoil. Additionally, this jerky recoil can negatively impact the speed, accuracy, and/or precision of subsequent shots.

In certain aspects, the present disclosure provides improvements to reduce the possibility of malfunction in a firearm. The present disclosure also provides improvements to reduce the impact experienced by a shooter when shooting a firearm.

The present disclosure provides an improvement for a slide for a firearm, the slide having a forward-facing breech face and a downward-facing surface that contacts a cartridge in a magazine received within the firearm when the slide forms part of the firearm, the downward-facing surface having a length along which the cartridge in the magazine slides during operation of the firearm, wherein the improvement comprises: the downward-facing surface is sloped along the length the cartridge in the magazine slides, from a lower end adjacent the breech face to an upper end positioned rearward of the breech face.

The downward-facing surface can be sloped along a distance at least as long as a cartridge the firearm is arranged to receive. The downward-facing surface can slope continuously along the length. The downward-facing surface can be sloped gradually along the length. The downward-facing surface can be planar. The downward-facing surface can slope continuously along a length from the breech face to a rearward hammer face of the slide. The downward-facing surface can be free of a protrusion along the length. The downward-facing surface can be transverse relative to a longitudinal axis of the slide. The longitudinal axis can be co-axial with the firing pin bore.

In any of the disclosed arrangements, an angle measured between the downward-facing surface and the breech face can be between 80 degrees and 90 degrees. The angle can be between 85 degrees and 89 degrees. For example, the angle can be approximately 88 degrees.

Firearm arrangements comprising any of the improvements and/or structure described herein are also envisioned.

The present disclosure provides firearm arrangements that gradually and continually move a cartridge in a magazine or clip away from the breech of the firearm while the slide assembly or bolt assembly extracts a casing from the chamber.

The present disclosure provides firearm arrangements that continually vary the position of a cartridge in a magazine or clip in response to longitudinal movement of a slide assembly or bolt assembly during firing operation.

The language used in the claims and the written description is to only have its plain and ordinary meaning, except for terms explicitly defined below. Such plain and ordinary meaning is defined here as inclusive of all consistent dictionary definitions from the most recently published (on the filing date of this document) general purpose Merriam-Webster dictionary.

As used in the claims and the specification, the following terms have the following defined meanings:

The term "cartridge" means a casing, propellant, and projectile (e.g., bullet) assembly. Cartridges also commonly include a primer used to ignite the propellant which creates the pressure to drive the projectile from the casing and down the barrel of a firearm.

The term "casing" means a cylindrical body that retains a projectile and propellant.

The term "firearm" means a rifle, pistol, shotgun, or other gun that can be supported by hand during operation. The term includes, but is not limited to, handguns.

The term "slide assembly" means a slide having at least one of the following items attached thereto: firing pin, extractor, ejector, front sight, rear sight, chambered round indicator, barrel, guide rod, and/or recoil spring.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
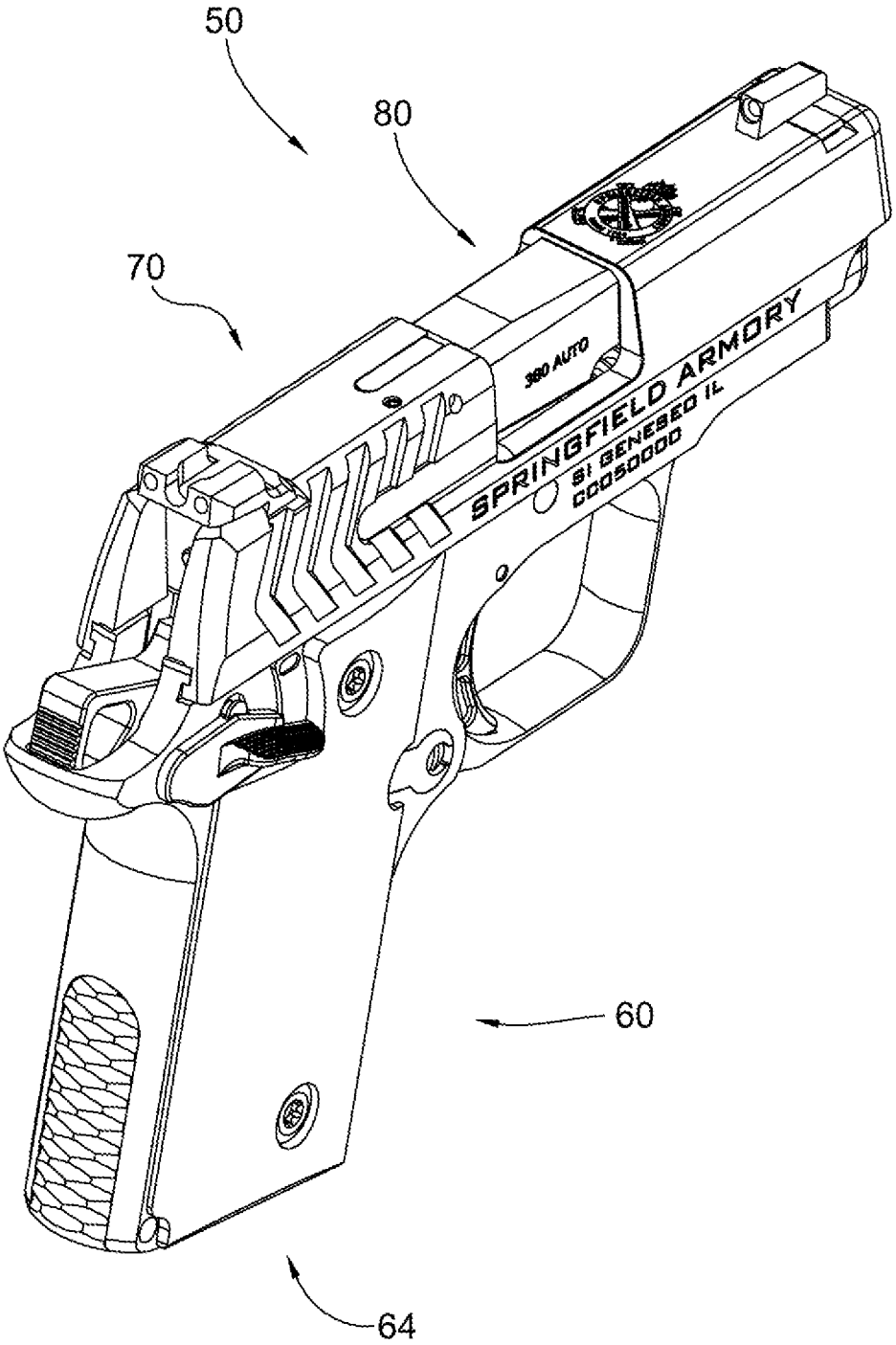
FIG. 1 is perspective view of an exemplary firearm of the present disclosure.
Figure 2:
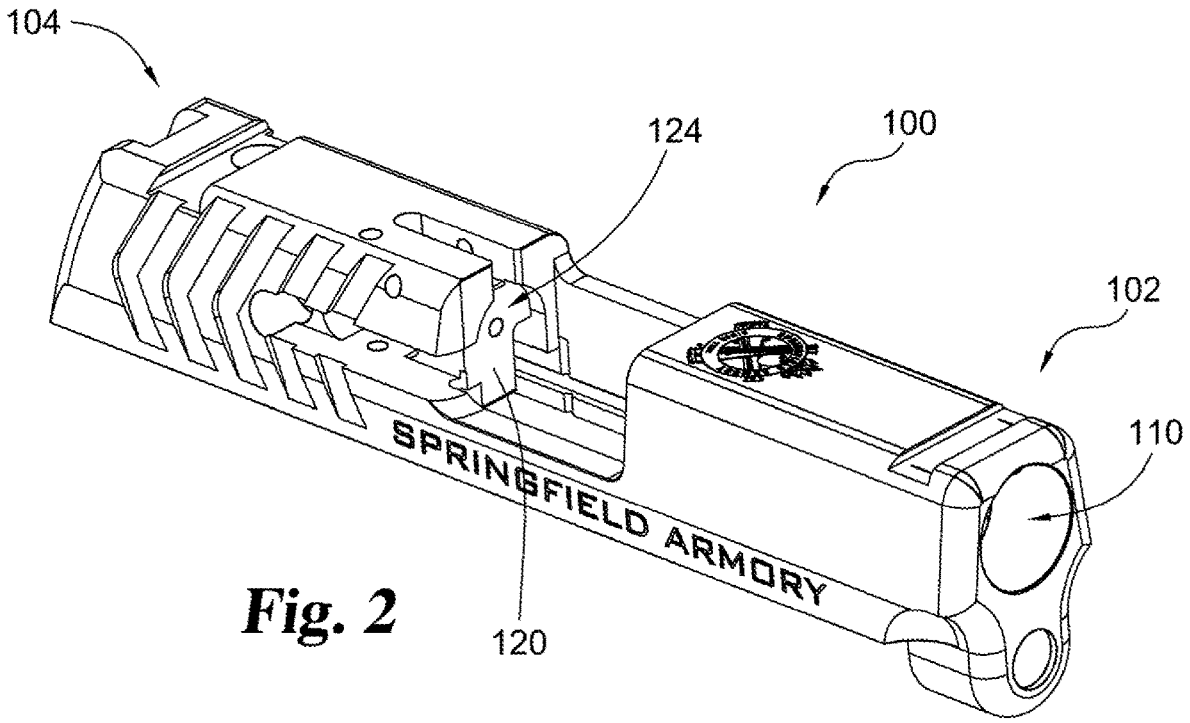
FIG. 2 is a perspective view of the slide of the firearm of FIG. 1.
Figure 3:
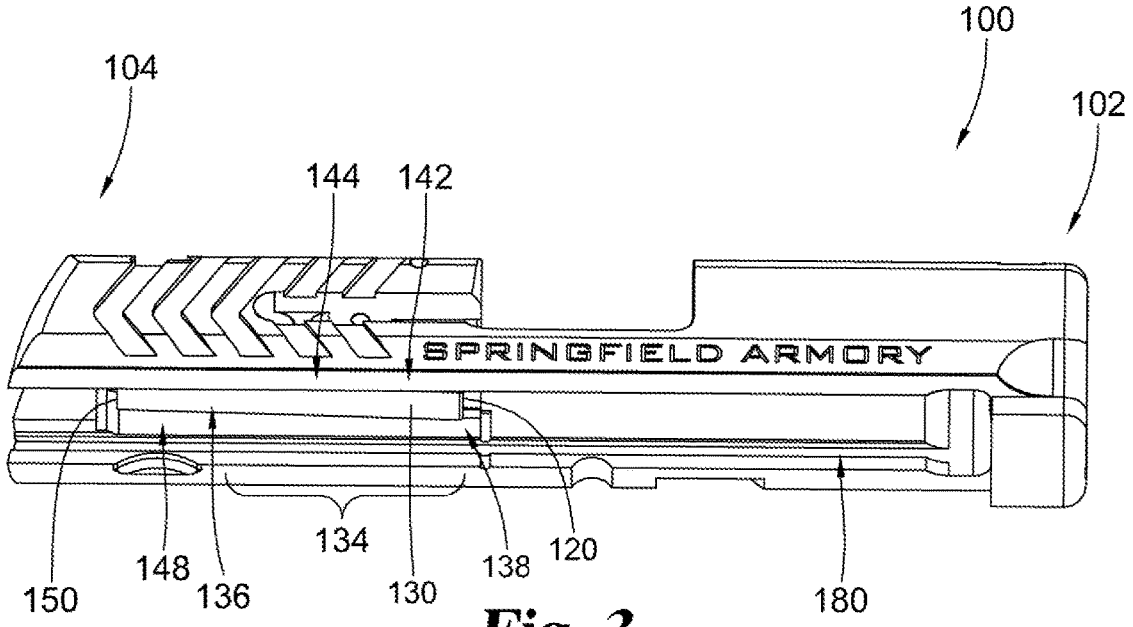
FIG. 3 is a perspective view of the slide of the firearm of FIG. 1.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Turning to the illustrated embodiment, FIG. 1 illustrates a handgun 50. The handgun has, among other components, a frame assembly 60 and a slide assembly 70. The frame assembly defines an opening 64 for receiving a magazine containing cartridges. During operation of the handgun, the slide assembly reciprocates relative to the frame. When reciprocating forward relative to the frame, the slide 100 of the slide assembly strips a cartridge from a magazine positioned within the frame and loads the cartridge into a chamber of the barrel 80. When reciprocating reward relative to the frame, portions of the slide assembly extract the cartridge, or what is left thereof (e.g., the casing), from the barrel.

FIGS. 2-5 illustrate a slide 100 from the slide assembly. The slide has a forward end 102 and a rearward end 104. The forward end defines a barrel opening 110 arranged to receive the barrel. Facing the barrel opening is a breech face 120. The breech face is arranged to contact the base of a cartridge when the cartridge is inserted in the chamber of the barrel. The breech face defines a firing pin opening 124.

Extending rearward of the breech face on the bottom of the slide is a downward-facing surface 130. The downward-facing surface faces the magazine positioned within the frame assembly when the handgun is assembled. During operation, a cartridge-contacting portion 134 of the downward-facing surface contacts a cartridge positioned within the magazine. As the slide actuates rearwardly relative to the frame assembly of the handgun (i.e., rearwardly from the position illustrated in FIG. 1), the point of contact between the cartridge in the magazine and the cartridge-contacting surface slides from a first location 136 to a second location 138 on the cartridge-contacting surface.

The cartridge-contacting surface slopes upwards (i.e., toward a top surface of the slide) from a lower forward portion 142 to a higher rearward portion 144. The sloped surface, however, can extend beyond the cartridge-contacting surface. For example, a rearward portion 148 of the downward-facing surface can be sloped. In some instances, the downward-facing surface can be sloped along its length. The length of the downward-facing surface can extend from the breech face to a hammer face 150.

The slide includes longitudinal grooves 180 on both sides of the frame and lying in a horizontal plane relative to the firearm. The longitudinal grooves are arranged to slidingly engage with rails of the frame. The slope(s) of the downward-facing surface, described herein, can be transverse relative to the plane of the longitudinal grooves.

Figure 4:
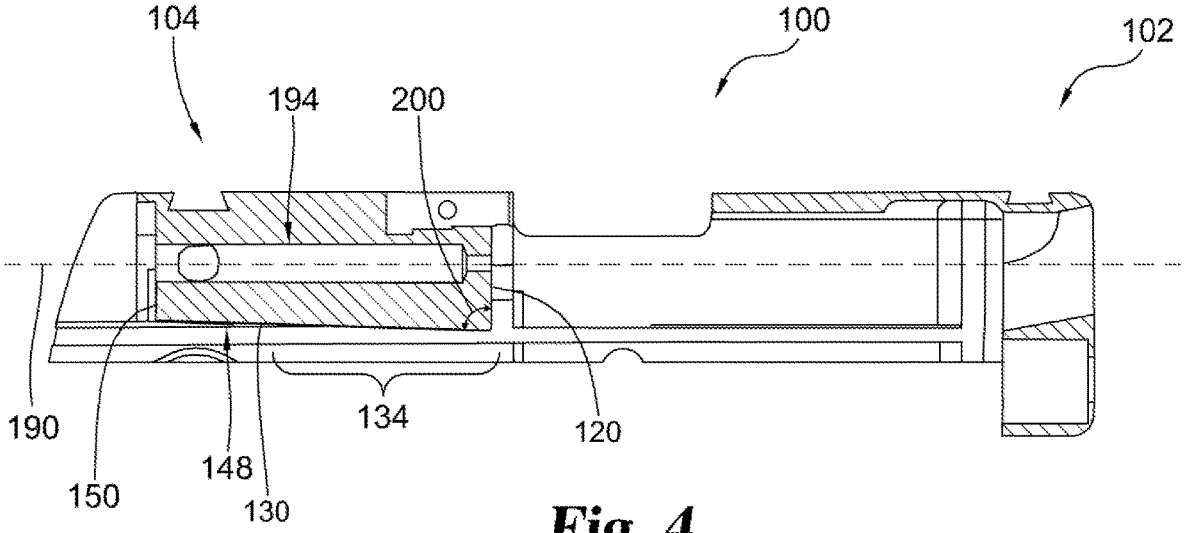
FIG. 4 is a cross-sectional view of the slide of the firearm of FIG. 1.

As illustrated in FIG. 4, the slide may have a longitudinal axis 190. The longitudinal axis may be coaxial with a firing pin bore 194. The slope(s) of the downward-facing surface, described herein, can be transverse to the longitudinal axis.

Also as illustrated in FIG. 4, the angle 200 between the breech face and the downward-facing surface can be between 80 degrees and 90 degrees. Preferably, the angle is between 85 degrees and 89 degrees. For example, the angle can be approximately 88 degrees.

Figure 5:
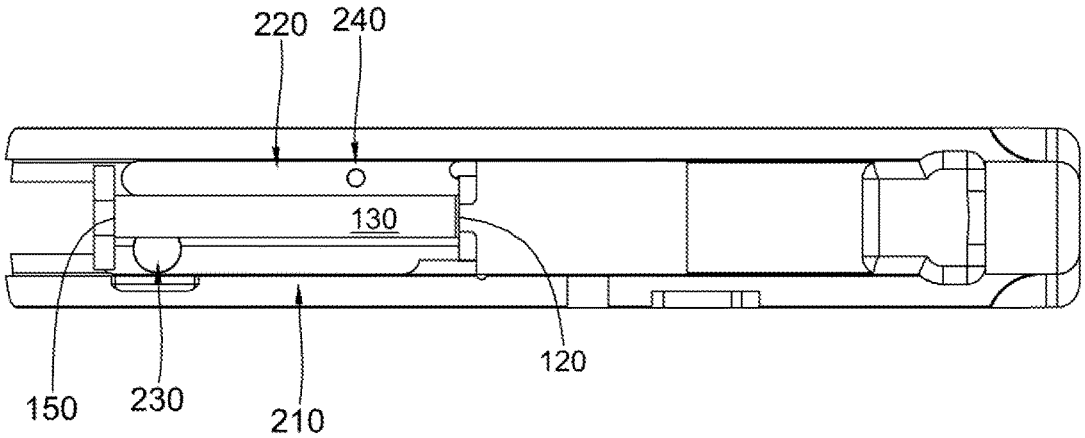
FIG. 5 is a bottom view of the slide of the firearm of FIG. 1.

As shown in FIG. 5, the downward-facing surface can be bounded on a first side by a first groove 210 and bounded on a second side by a second groove 220. An opening 230 for the firing pin safety can extend through the first groove. An opening 240 for an extractor pin can extend through the second groove. The first and/or second grooves can provide clearance for the ejector and/or safety components of the firearm.

Figure 6:
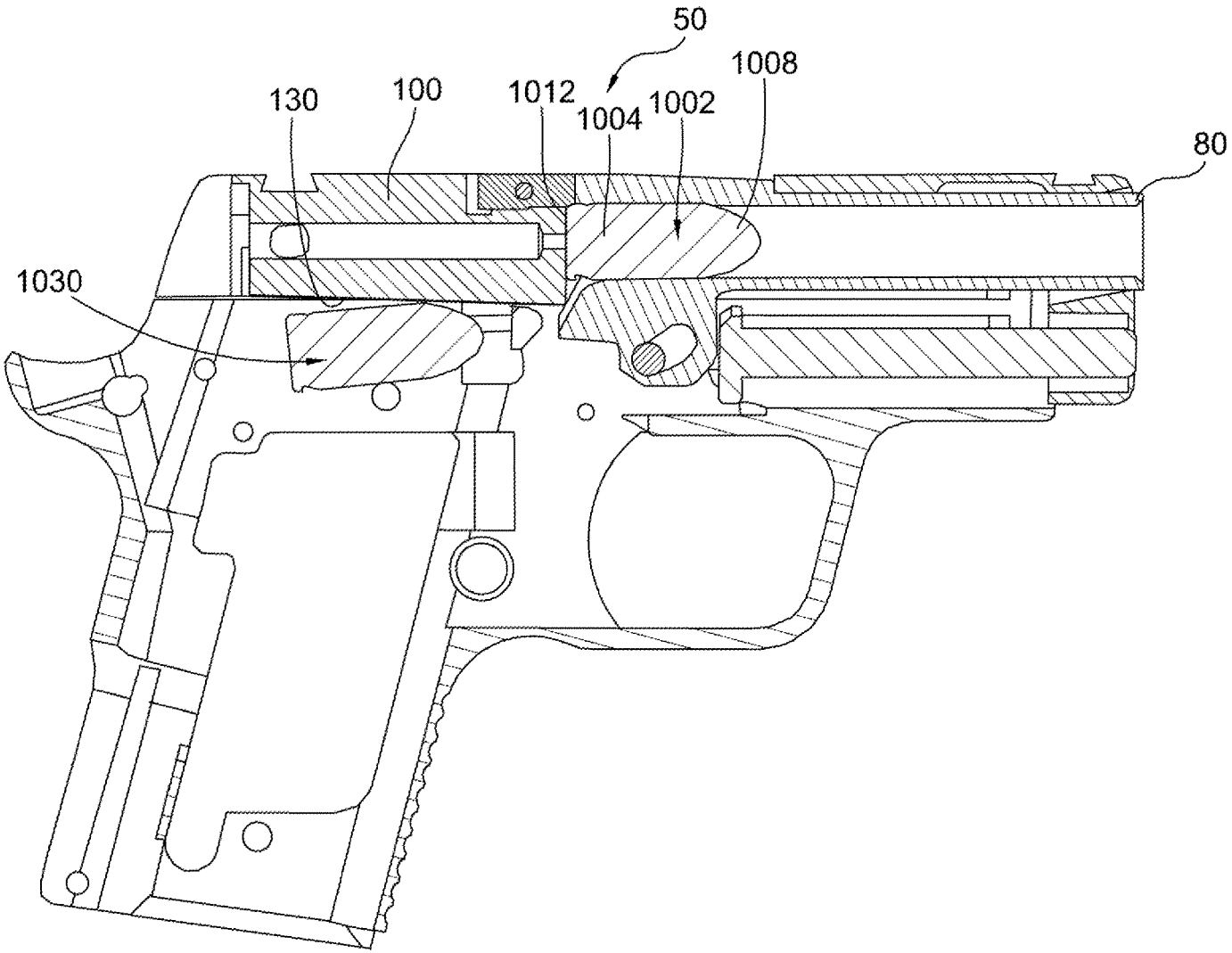
FIG. 6 is a cross-sectional view of portions of the firearm of FIG. 1 in a first configuration.
Figure 7:
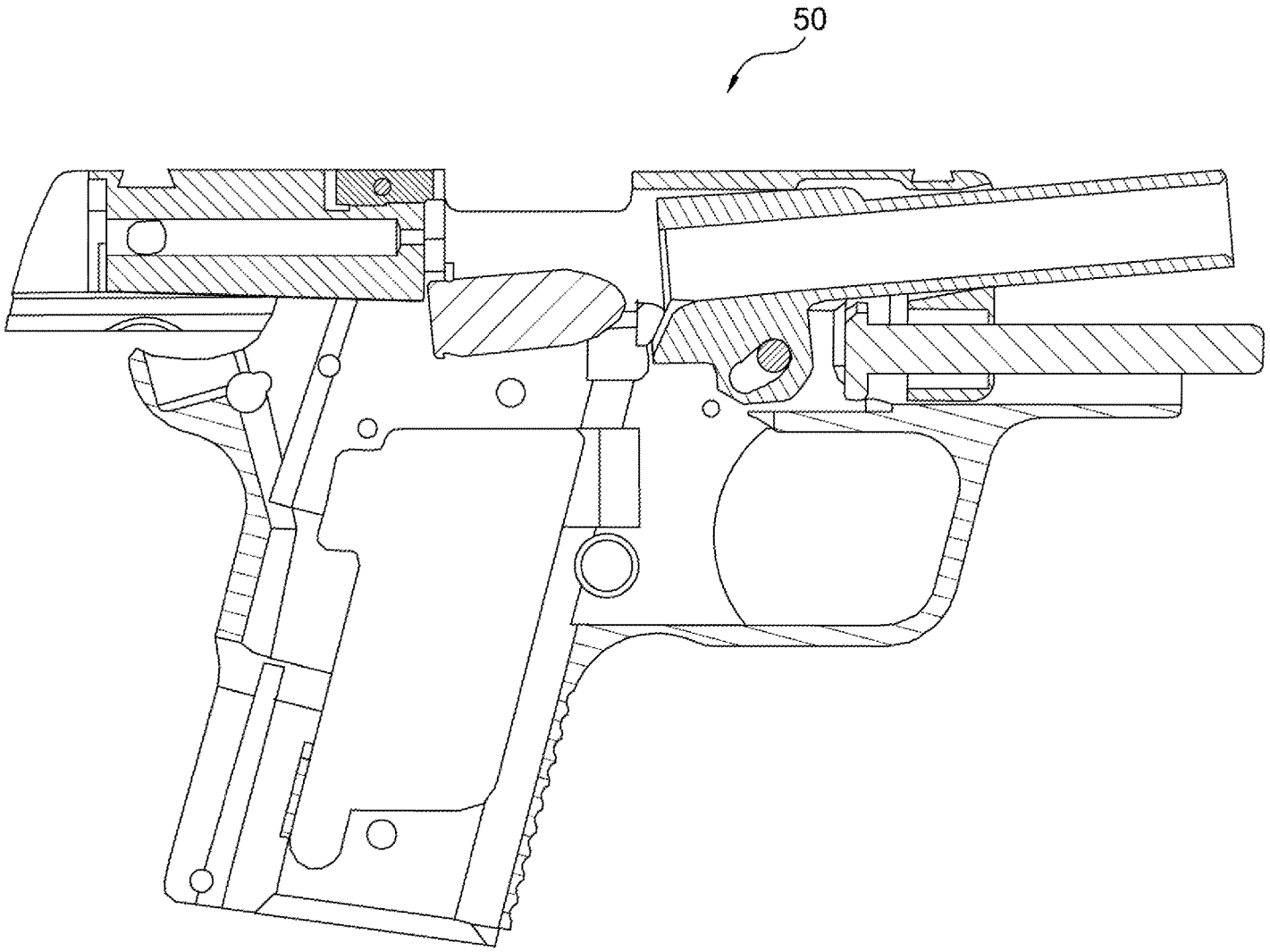
FIG. 7 is a cross-sectional view of portions of the firearm of FIG. 1 in a second configuration.

FIGS. 6 and 7 illustrate a cross-sectional view of portions of the firearm during different stages of a firing sequence. In FIG. 6, a first cartridge 1002 comprising a casing 1004 and a projectile 1008 are positioned within the chamber of the barrel with the breech face of the slide in contact with the base 1012 of the cartridge. A second cartridge 1030 is positioned in the magazine (not shown) and is in contact with a sloped portion of the downward-facing surface of the slide. In FIG. 7, the slide is shown returning to a forward position from the rearward position and is now beginning to load the second cartridge into the chamber after having successfully extracted and ejected the casing of the first cartridge.

If the firearm in the configuration shown in FIG. 6 is discharged, the slide will move in a rearward direction relative to the frame assembly (i.e., to the left as shown in the figures). While moving rearwardly, the extractor of the slide assembly retains the casing of the first cartridge in association with the slide so that the casing is removed from the chamber as the slide moves rearwardly relative to the barrel. When the slides moves rearwardly from the configuration shown in FIG. 6, the downward-facing surface 130 of the slide moves the second cartridge (i.e., one in the magazine) downwardly and away from the casing of the first cartridge so that the second cartridge does not contact the casing of the first cartridge.

Advantageously, the disclosed arrangements can also provide greater overlap of the breech face of the slide and the second cartridge. Applicant has found this improved overlap (as shown in FIG. 7) to provide a more reliable loading of cartridges from the magazine and into the chamber when the slide moves in a forward direction. Accordingly, the disclosed arrangements can decrease the possibility of Type 1 malfunctions.

Another benefit of the sloped downward-facing surface is greater space for hammer components at the rearward end of the firearm. As the downward-facing surface slopes upward toward the rear end of the firearm, components of the hammer assembly do not need to be repositioned lower.

While the above description has referred to a bottom-facing surface of a slide, the improvements and arrangements disclosed herein may also be made to bolt assemblies. For example a bottom-facing surface of a bolt assembly, such as a bolt assembly (e.g., bolt carrier group) of an AR style firearm (e.g., AR-15 or M-16), may be sloped. For example, a bottom-facing surface of a bolt carrier may be sloped along the length of a cartridge contacting portion.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The following numbered clauses set out specific embodiments that may be useful in understanding the present invention:

1. An improvement for a slide for a firearm, the slide having a forward-facing breech face and a downward-facing surface that contacts a cartridge in a magazine received within the firearm when the slide forms part of the firearm, the downward-facing surface having a length along which the cartridge in the magazine slides during operation of the firearm, wherein the improvement comprises:

the downward-facing surface is sloped along the length the cartridge in the magazine slides, from a lower end adjacent the breech face to an upper end positioned rearward of the breech face.

2. The slide of clause 1, wherein:

the downward-facing surface is sloped along a distance at least as long as a cartridge the firearm is arranged to receive.

3. The slide of any preceding clause, wherein:

the downward-facing surface slopes continuously along the length.

4. The slide of any preceding clause, wherein:

the downward-facing surface is sloped gradually along the length.

5. The slide of any preceding clause, wherein:

the downward-facing surface is planar.

6. The slide of any preceding clause, wherein:

the downward-facing surface slopes continuously along a length from the breech face to a rearward hammer face of the slide.

7. The slide of any preceding clause, wherein:

the downward-facing surface is free of a protrusion along the length.

8. The slide of any preceding clause, wherein:

the downward-facing surface is free of an inside corner along the length.

9. The slide of any preceding clause, wherein:

the downward-facing surface is transverse relative to a longitudinal axis of the slide.

10. The slide of any preceding clause, wherein:

the longitudinal axis is co-axial with the firing pin bore.

11. The slide of any preceding clause, wherein:

an angle measured between the downward-facing surface and the breech face is between 80 degrees and 90 degrees.

12. The slide of any preceding clause, wherein:

the angle is between 85 degrees and 89 degrees.

13. The slide of any preceding clause, wherein:

the angle is approximately 88 degrees.

14. A firearm comprising a slide having the improvement described in any preceding clause.

The invention claimed is:

1. An improvement for a slide for a hammer-fired firearm, the slide having a forward-facing breech face, a rearward-facing hammer face, and a downward-facing surface that contacts a cartridge in a magazine received within the firearm when the slide forms part of the firearm, the downward-facing surface having a length extending from the forward-facing breech face to the rearward-facing hammer face and having a portion along which the cartridge in the magazine slides during operation of the firearm, wherein the improvement comprises:

the downward-facing surface is sloped along the entire length of the downward-facing surface, from a lower end adjacent the breech face to an upper end positioned rearward of the breech face;

wherein the downward-facing surface is free of an inside corner along the length; and wherein the rearward-facing hammer face and the forward-facing breach face define ends of a firing pin bore of the slide.

2. The improvement of claim 1, wherein:

the downward-facing surface slopes continuously along the length.

3. The improvement of claim 1, wherein:

the downward-facing surface is sloped gradually along the length.

4. The improvement of claim 1, wherein:

the downward-facing surface is planar.

5. The improvement of claim 1, wherein:

the downward-facing surface is free of a protrusion along the length.

6. The improvement of claim 1, wherein:

the downward-facing surface is transverse relative to a longitudinal axis of the slide.

7. The improvement of claim 6, wherein:

the longitudinal axis is co-axial with a firing pin bore of the slide.

8. The improvement of claim 1, wherein:

an angle measured between the downward-facing surface and the breech face is between 80 degrees and 90 degrees.

9. The improvement of claim 8, wherein:

the angle is between 85 degrees and 89 degrees.

10. The improvement of claim 9, wherein:

the angle is approximately 88 degrees.

11. A firearm comprising a slide having the improvement described in claim 1.

12. The improvement of claim 1, wherein a rearward hammer face of the slide extends above and below an opening for a firing pin bore of the slide.

13. The improvement of claim 1, wherein the downward-facing surface is bounded on a first lateral side by a first groove and on an opposing, second lateral side by a second groove.

14. The improvement of claim 13, wherein an opening for a firing pin safety extends through the first groove.

15. An improvement for a slide for a hammer-fired firearm, the slide having a forward-facing breech face and a downward-facing surface that contacts a cartridge in a magazine received within the firearm when the slide forms part of the firearm, the downward-facing surface having a length along which the cartridge in the magazine slides during operation of the firearm, wherein the improvement comprises:

the downward-facing surface is sloped along the length the cartridge in the magazine slides, from a lower end adjacent the breech face to an upper end positioned rearward of the breech face;

wherein the downward-facing surface is bounded on a first lateral side by a first groove and on an opposing, second lateral side by a second groove; and wherein an opening for an extractor pin extends through the second groove.

16. The improvement of claim 15, wherein the downward-facing surface extends from the breech face to a rearward-facing hammer face and is sloped along its entirety.

17. The improvement of claim 15, wherein the downward-facing surface is free of an inside corner along the length.

18. The improvement of claim 15, wherein:

an angle measured between the downward-facing surface and the breech face is between 80 degrees and 90 degrees.

19. The improvement of claim 18, wherein:

the angle is between 85 degrees and 89 degrees.

20. The improvement of claim 19, wherein:

the angle is approximately 88 degrees.

* * * * *